United States Patent [19]

Genuit

[11] 4,228,553

[45] Oct. 21, 1980

[54] STORAGE AND DISPENSING APPARATUS FOR SWIMMING POOL VACUUM HOSE

[76] Inventor: Luther L. Genuit, 6231 Calle Del Paisano, Scottsdale, Ariz. 85251

[21] Appl. No.: 957,899

[22] Filed: Nov. 6, 1978

[51] Int. Cl.[3] ..... E04H 3/20; B65H 75/40

[52] U.S. Cl. ..... 4/490; 15/1.7; 134/167 R; 137/355.27; 242/86.2; 4/496

[58] Field of Search ..... 4/172, 172.15–172.17; 134/167 R, 168 R; 242/86–86.4, 86.7; 137/355.19, 355.26, 355.27; 15/1.7, 104.3 SN

[56] References Cited

U.S. PATENT DOCUMENTS

| | | | |
|---|---|---|---|
| 2,431,089 | 11/1947 | Therrien | 15/104.3 SN |
| 2,595,655 | 5/1952 | Hannay | 242/86 |
| 3,225,974 | 12/1965 | Athas | 242/86 X |
| 3,341,880 | 9/1967 | Young | 15/1.7 X |
| 3,351,968 | 11/1967 | Masters | 15/104.3 SN |
| 3,370,599 | 2/1968 | Ciaccio | 15/104.3 SN |
| 3,412,862 | 11/1968 | Chaplin | 15/1.7 |
| 3,416,176 | 12/1968 | Ravitts | 15/1.7 |
| 3,595,497 | 7/1971 | Boatright | 242/86.7 X |
| 3,676,884 | 7/1972 | Wulc | 15/1.7 |
| 3,774,630 | 11/1973 | Prange | 137/355.26 X |
| 3,997,429 | 8/1976 | Stevenson | 242/86 X |

FOREIGN PATENT DOCUMENTS

| | | | |
|---|---|---|---|
| 21622 | 4/1956 | Fed. Rep. of Germany | 15/1.7 |

*Primary Examiner*—Stuart S. Levy
*Attorney, Agent, or Firm*—Warren F. B. Lindsley

[57] ABSTRACT

A portable or stationary apparatus incorporating a reel for storage of the swimming pool vacuum hose and a means for submerging the hose as it is unwound into the pool, assuring thereby the filling of the hose with water coincident with its being dispensed into the pool. The evacuation of air from the hose permits the immediate connection of the hose to the vacuum pump without causing the pump to lose its prime.

14 Claims, 13 Drawing Figures

STORAGE AND DISPENSING APPARATUS FOR SWIMMING POOL VACUUM HOSE

BACKGROUND OF THE INVENTION

The most difficult and time consuming operation in the routine maintenance of a home swimming pool is the vacuum cleaning procedure and especially that part of the procedure involving the handling of the vacuum hose.

Once or twice a week depending on the season of year and weather conditions, it becomes necessary to remove excessive accumulations of dirt, leaves, etc., which have blown into the pool and settled to the bottom. For this purpose, nearly every pool owner has a vacuum hose and a pick-up head. The hose connects the pick-up head to the intake line of the pool filtration pump at the skimmer, and the pick-up head is attached to the end of a long pole which serves as a handle. The operator moves the pick-up head over the floor of the pool and the dirt is picked up, carried by the water through the hose and discharged to waste or retained by the pool filter. Leaves and bugs are caught by a screen ahead of the filter and may be removed.

A particularly difficult part of the vacuuming procedure which consumes a very significant part of the total time involved in the operation is the handling of the vacuum hose. For a family-size pool the hose may be forty or more feet long. It is made of plastic, has a diameter of approximately two inches and has stiffening ribs spaced at half-inch intervals along its length which enhance its ability to support the reduced internal pressure associated with the pump vacuum. The hose is relatively inflexible and difficult to handle and it gets tangled easily. It is also difficult to coil and uncoil for storage and use. In addition, it is necessary to remove the air from inside the hose by filling it with water before it is connected to the pump so that the prime of the pump will not be lost. Such an occurrence can result in damage or excessive wear to the pump.

In the usual method for clearing air from the hose, the operator throws the hose into the pool, attaches one end to the pick-up head, and then, beginning at the same end and working along the length of the hose, he pushes the normally floating hose under the surface, causing it to fill with water. A pool brush attached to a pole is often used as a tool. This method is time consuming and not always totally effective so that air pockets may remain. The pockets of air momentarily cause interruptions in the prime of the pump during the initial period following connectionof the hose to the pump inlet.

After the vacuum operation has been completed, the hose is removed from the pool, drained of water and, in the more ordered households, it is hung up on pegs affixed to a fence or to the side of a building. Again, because the hose is so unwieldy, this is a difficult, awkward and time consuming procedure. Furthermore, the handling of the hose as it twists, turns and tangles is detrimental to the hose itself and causes its useful life to be significantly shortened.

For these reasons a better means is needed for handling the vacuum hose including means for storing the hose, for dispensing it into the pool and for removing the air prior to making connection to the pump.

SUMMARY OF THE INVENTION

In accordance with the invention claimed, a storage and dispensing apparatus is provided for a swimming pool vacuum hose, the chief purpose of the apparatus being a simplification of the procedures and a reduction in the time involved in the vacuum cleaning of a swimming pool.

It is therefore one object of this invention to provide an apparatus for conveniently storing, dispensing and handling a swimming pool vacuum hose.

Another object of this invention is to provide such an apparatus in a form which prevents the hose from becoming twisted or tangled during the storage or dispensing operations.

A further object of this invention is to provide in such an apparatus a means for submerging the hose and causing it to be filled with water as it is dispensed into the swimming pool for use.

A still further object of this invention is to provide such an apparatus in a mobile or in a stationary form.

A still further object of this invention is to provide in the mobile form of the apparatus means for causing the apparatus to remain in position during the dispensing of the hose.

A still further object of this invention is to provide through the convenience inherent in the use of the apparatus a significant reduction in the total time involved in the vacuum cleaning operation.

A still further object of this invention is to assure through the use of the apparatus a reduction in the mechanical stress applied to the hose during its handling so that a longer useful life for the hose will be realized.

Yet another object of this invention is to provide such an apparatus in a simple, lightweight and inexpensive form.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWING

The present invention may be more readily described by reference to the accompanying drawing, in which.

DESCRIPTION OF THE PREFERRED EMBODIMENT

Figure 1:
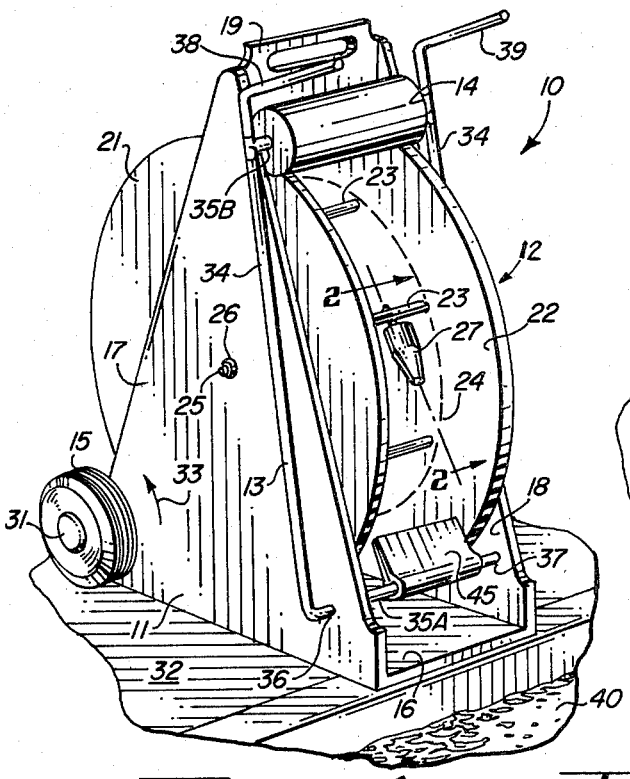
FIG. 1 is a perspective view of the vacuum hose storage and dispensing apparatus of the invention in a first embodiment.
Figure 2:
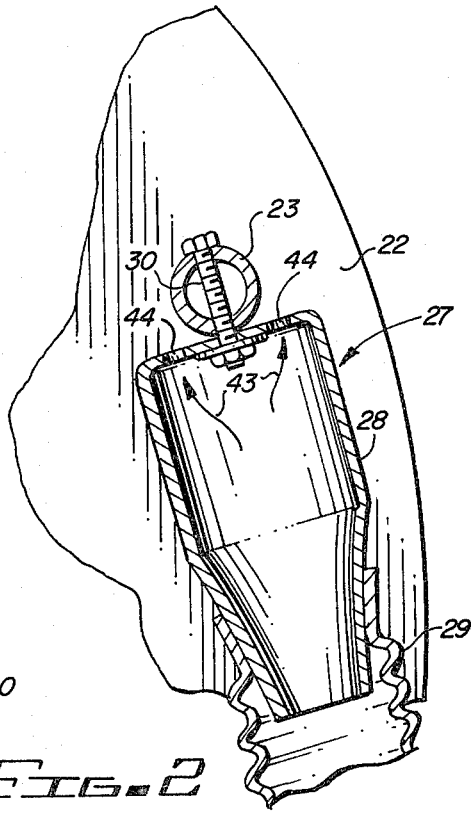
FIG. 2 is a cross-sectional view of a portion of the apparatus employed for securing the end of the hose, the view being taken along the line 2—2 of FIG. 1.
Figure 3:
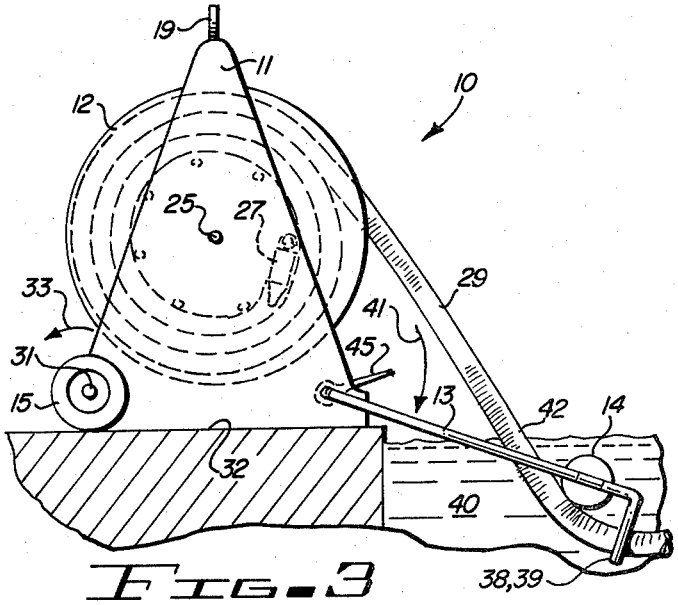
FIG. 3 is a side view of the apparatus as seen during the dispensing of the hose from the apparatus into the swimming pool.

Referring more particularly to the drawing by characters of reference, FIGS. 1-3 disclose the vacuum hose storage and dispensing device or apparatus 10 of the invention. The apparatus 10 comprises a frame 11, a reel 12, a swinging arm 13, a submerging roller 14, and wheels 15.

The frame 11 has a horizontal rectangular base 16, having a length approximately three times its width. Attached to the longer two edges of the base 16 are two vertical side plates 17 and 18. The side plates approximate upright isosceles triangles. Joining the top ends of the two side plates 17 and 18 is a slotted cross-member 19 which stiffens the frame 11 and serves as a handle for moving the apparatus 10.

The reel 12 in the embodiment of FIGS. 1-3 comprises two parallel coaxial circular side members 21 and 22 joined by a number of transverse rods 23. The rods 23 are uniformly spaced about the circumference of a circle 24 which is centered relative to the common axis of the side members 21 and 22. The diameter of the circle 24 is approximately one-half the diameter of one of the side members 21 or 22. The ends of the rods 23 may be cemented or welded to the inner surfaces of the side members 21 and 22. For enhanced rigidity and strength, their ends may extend into blind holes provided in the inner surfaces of the side members 21 and 22.

As an alternate construction, the rods 23 may be replaced by hollow pipes or tubes. Bolts or threaded studs passing through the pipes and through aligned holes in the side members 21 and 22 may then be utilized to clamp the side members 21 and 22 against the opposite ends of the pipes to form a rigid structure for the reel 12.

A shaft 25 passed through the center of reel 12 and through centered, oppositely positioned holes in the plates 17 and 18 of frame 11 is secured by a nut 26. The shaft 25 serves as the rotational axis for the reel 12.

Attached to one of the rods 23 is a hose gripper 27. As shown most clearly in FIGS. 1 and 2, the initial implementation of the gripper 27 utilized a plastic bottle 28. The conical or cone-shaped configuration such as the neck of bottle 28 is appropriately dimensioned and tapered to fit inside the end of a vacuum hose 29 so that when the end of hose 29 is thrust over the neck of bottle 28, a gripping action is realized between the two parts. A machine screw 30 is passed through a hole in the bottom of the plastic bottle 28 and edgewise through one of the rods 23. In this case rod 23 is in the form of a hollow tube which is free to rotate about its own axis so that a pivotal mounting is thereby afforded for gripper 27. Because of the pivotal freedom of gripper 27, the attached hose is free to assume an unstressed position as it is wound onto reel 12 during a storage operation.

Wheels 15 are mounted at the ends of an axle 31 which passes through two aligned holes located opposite each other in the lower rear corners of plates 17 and 18 of frame 11. In the rest position of frame 11, as shown in FIGS. 1 and 3, the vertical position of axle 31 is just high enough from surface 32, on which apparatus 10 rests, so that the outer diameters of the wheels do not touch surface 32. Apparatus 10 is thus prevented from rolling or moving out of its rest position. As the apparatus 10 is tilted backward, however, wheels 15 come into contact with surface 32 and support the weight of the apparatus 10 so that it may be conveniently moved about.

The swinging arm 13 has a generally rectangular picture-frame configuration comprising two long parallel side members 34, joined at or near their ends by two shorter transverse members 35A and 35B. Members 34 are approximately equal in length to the diameter of reel 12, and members 35A and 35B are somewhat longer than the width of frame 11. Member 35A passes through two opposing aligned holes 36 and 37 located near the lower front corners of the side plates 17 and 18 of frame 11, and it forms therewith a pivotal mounting means for arm 13. Member 35B serves as the axle for roller 14. Members 34 extend somewhat beyond the points at which member 35B is attached, and then bend outward at right angles to form two guide bars, 38 and 39.

In the utilization of apparatus 10 during the vacuuming operation, apparatus 10 with the hose 29 wound on reel 12 is first moved into position at the edge of the swimming pool, as shown in FIGS. 1 and 3. The free end of hose 29 extends downward toward the pool from the top of reel 12. After attaching the free end of hose 29 to the vacuum head and after also attaching a pole or handle to the vacuum head, the operator lowers the vacuum head to the bottom of the pool at the edge of the pool adjacent apparatus 10. As this is done a portion of hose 29 is unwound from reel 12 and extends downwardly into water 40. The swinging arm 13 is then pivoted forward in the direction 41 and the roller 14 comes to rest against the upper surface of hose 29, the weight of the roller 14 causing hose 29 to be submerged in water 40. The operator then again takes up the handle attached to the vacuum head and drags the vacuum head toward the opposite end of the pool while keeping the vacuum head submerged. As this is done, hose 29 unwinds from reel 12 which freely rotates about its own axis 25. During the unwinding of hose 29, guide bars 38 and 39 keep the hose 29 in position under roller 14. Also during this time, water enters the vacuum head and flows into hose 29, filling it to the point of submersion 42. The air 43 which is displaced during the filling with water of hose 29 is exhausted through air holes 44 in the base of hose gripper 27. The weight of roller 14 all the while holds the unwinding portion of hose 29 under water causing the hose to be submerged and filled with water as it is drawn off of reel 12. When the total length of the hose 29 has been drawn off reel 12, its end is pulled free from gripper 27 and is manually submerged beneath the surface of the water to complete the filling of the hose and the evacuation of the last quantity of air. The end of the hose is then thrust into the vacuum hose connection inside the pool skimmer in readiness for the initiation of the vacuuming operation.

After the completion of the vacuuming operation, the end of hose 29 is withdrawn from its connection at the skimmer and is again attached to the hose gripper 27 in reel 12. The other end of the hose is then disconnected from the vacuum head and the hose is rewound onto reel 12 by rotating the reel in the direction opposite to that in which it had rotated as the hose was unwound into the pool. In this manner hose 29 is restored to its original position on reel 12. The arm 13 is then pivoted upward to the position shown in FIG. 1. Finally the operator grips the slotted cross-member 19, tilts the apparatus 10 in the direction 33 until it is supported by wheels 15. He then moves the apparatus 10 with the aid of wheels 15 to a convenient storage location.

While the apparatus 10 is being moved from one location to another there is a tendency for the reel 12 to rotate about its axis with the result that the hose 29 may unwind from reel 12. To prevent this from happening, a brake member 45 may be attached to member 35A of arm 13 as shown in FIGS. 1 and 3. Member 45 may be a flexible plastic or rubber flap having one edge rigidly attached to member 35A, its free edge extending therefrom in the direction of reel 12 when arm 13 is in the stored position of FIG. 1. In this position of arm 13 the free edge of member 45 is brought to bear against reel 12 or against hose 29 when hose 29 is stored on reel 12. The pressure of member 45 against reel 12 or against hose 29 prevents the rotation of reel 12 and the unwinding of hose 29. When arm 13 is lowered to the dispensing position of FIG. 3, member 45 is rotated away from hose 29 and the braking action is released.

While the apparatus 10 is complete and totally functional relative to its intended use as shown in FIGS. 1–3, other means of construction will be found which may prove to afford various advantages related to convenience of use, reduced weight or cost.

Figure 4:
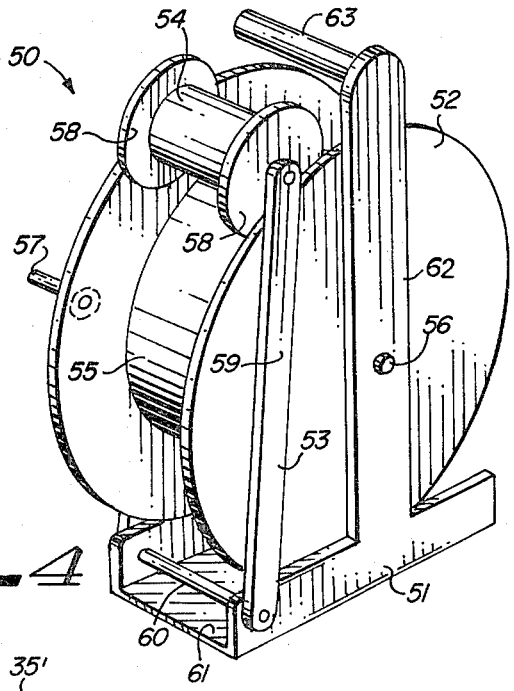
FIG. 4 is a perspective view of the vacuum hose storage and dispensing apparatus of the invention in a second embodiment.

One such variation as shown in FIG. 4, comprises a modified vacuum hose storage and dispensing apparatus 50, again comprising a frame 51, a reel 52, a swinging arm 53 and a roller 54. In this case the apparatus 50 has no wheels and is intended to be carried from one location to another or permanently located at the edge of the pool.

The reel 12 has a cylindrical core 55 instead of the transverse tubular members 23 employed in the construction of reel 12. Furthermore, the axle 56 is attached at only one end in cantilever fashion to frame 51. The opposite end of the reel 52 is thus clear of the frame and is free to be rotated by means of a handle 57 during the rewinding of hose 29. Instead of the guide bars 38 and 39 as the means for maintaining the position of the hose 29 relative to the roller 54, circular end plates 58 are provided at the ends of the roller 54, the diameters of the plates 58 being at least two hose diameters greater than the diameter of the roller 54.

The swinging arm 53 has only one long extending member 59 pivotally attached at one end to the lower forward part of the frame 51, preferably by means of a perpendicularly extending rod 60 which passes through oppositely aligned holes in the vertical sides of the frame 51.

The frame 51 is of a lightweight construction to facilitate carrying of the apparatus 50. It comprises a channel-shaped base 61 and a vertical support arm 62 which extends upward from the center of one side of the base 61. The axle 56 of reel 52 is attached just below the center of support arm 62 and a carrying handle 63 is attached at the top of arm 62.

With the exception that apparatus 50 is intended to be carried from place to place rather than being moved about on wheels, it functions in a manner identical to that described for apparatus 10.

Figure 5:
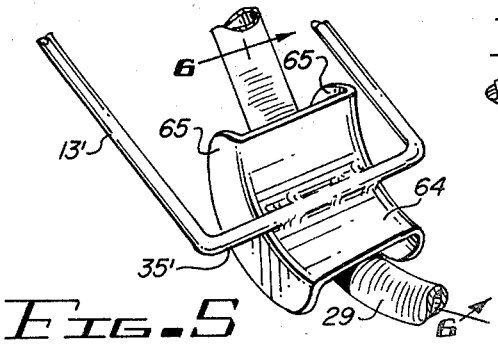
FIG. 5 is a perspective view of a deflector which is provided as an alternate means for submerging the hose as it is dispensed from the apparatus.
Figure 6:
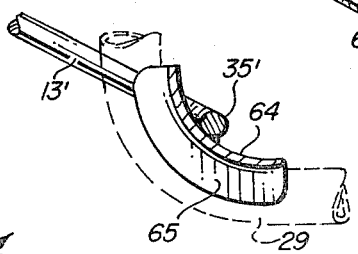
FIG. 6 is a cross-sectional view of the deflector of FIG. 5 as seen along line 6—6 of FIG. 5.

FIGS. 5 and 6 illustrate an alternative to the use of a roller 14 or 54 as the means for causing the hose 29 to be submerged as it is drawn off of reel 12 or 52 into the water. A curved concave or arcuate guide plate 64 is shown attached to the end of the swinging arm 13'. The curvature of plate 64 and its angle of attachment to the horizontal end member 35' of the arm 13' conforms to the curvature of the hose 29 as it is drawn into the pool. Perpendicularly extending flanges 65 at both sides of the plate 64 keep hose 29 centered under plate 64.

Figure 7:
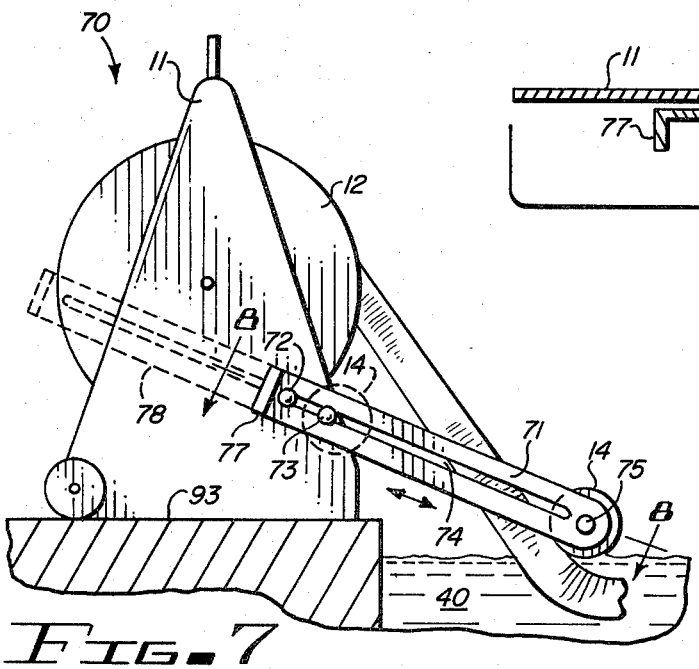
FIG. 7 is a side view of the vacuum hose storage and dispensing apparatus of the invention in a third embodiment.
Figure 8:
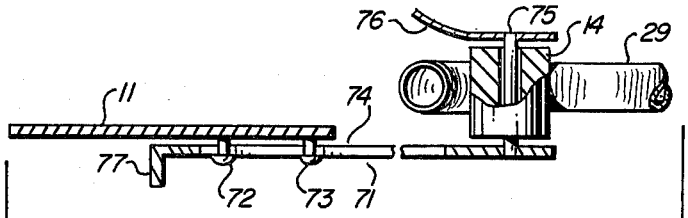
FIG. 8 is a cross-sectional view of a portion of the apparatus of FIG. 7 as seen along line 8—8 of FIG. 7.

FIGS. 7 and 8 illustrate a hose storage and dispensing apparatus 70 which is identical to the apparatus 10 of FIGS. 1–3 except that it utilizes a sliding arm 71 instead of the swinging arm 13 of FIGS. 1 and 2 to support the submerging roller 14.

The sliding arm 71 has the form of a long flat strip. It is slideably attached to one side of frame 11 by means of two capped pins 72 and 73, the bodies of which pass through a centered longitudinal slot 74 in arm 71. Pins 72 and 73 are aligned at an inclination relative to the horizontal so that arm 71 is appropriately directed outward and downward toward the water 40 when the apparatus 70 is positioned at the edge of the pool as shown in FIG. 7.

At the outer end of arm 71 the roller 14 is attached to arm 71 by means of a perpendicularly extending axle 75. The axle 75 is preferably rigidly mounted at one end to arm 71. The roller 14 rotates on axle 75. At the end of axle 75 opposite its attachment to arm 71 a retaining plate 76 is provided. Plate 76 holds roller 14 on axle 75 and it also prevents the hose 29 from slipping off roller 14 during the dispensing operation.

At the upper end of arm 71 a grip 77 is provided which is useful for the withdrawal of arm 71 from its extended position. In the implementation shown, grip 77 is simply a tab formed by a perpendicular bend at the end of arm 71. By taking hold of grip 77, the operator may readily move the arm 71 between the dispensing position shown in solid lines and the withdrawn or storage position shown by the broken line image 78 in FIG. 7.

Figure 9:
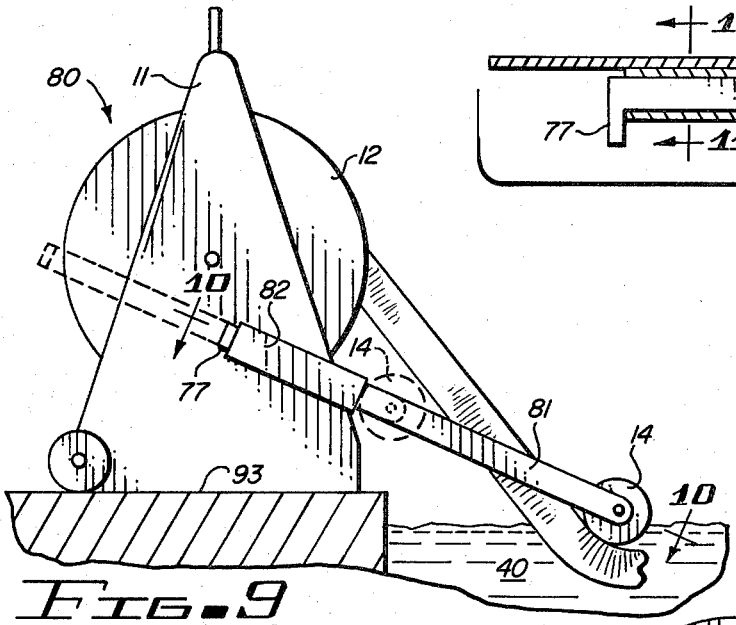
FIG. 9 is a side view of the vacuum hose storage and dispensing apparatus of the invention in a fourth embodiment.
Figure 10:
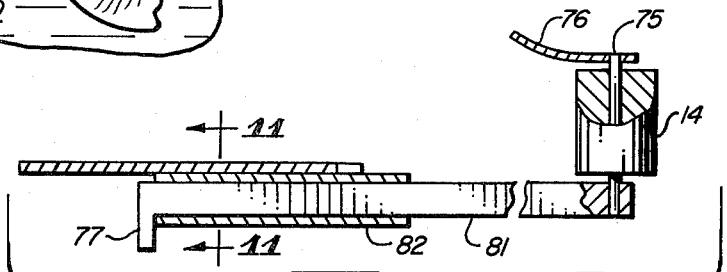
FIG. 10 is a cross-sectional view of a portion of the apparatus of FIG. 9 as seen along line 10—10 of FIG. 9.
Figure 11:
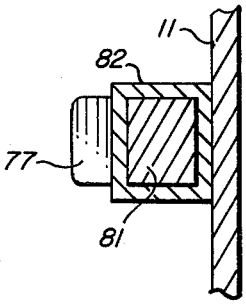
FIG. 11 is a cross-sectional view of a portion of the apparatus of FIGS. 9 and 10 as seen along line 11—11 of FIG. 10.

FIGS. 9–11 illustrate a storage and dispensing apparatus 80 which is another variation of the apparatus 10 of FIGS. 1–3 and which is even more closely similar to the apparatus 70 of FIGS. 7 and 8. The apparatus 80 differs from the apparatus 70 only in the construction of the arm which carries the submerging roller 14. Apparatus 80 utilizes a telescoping arm 81 having a substantially square cross-section as might be fabricated from bar stock or from a tubular material of square or rectangular form. Arm 81 passes through a long collar 82 having an internal longitudinal opening which mates with the outer contour of arm 71 (as shown in FIG. 11) with sufficient clearance to permit a longitudinal sliding action between the mating parts while preventing relative rotational motion. Collar 82 is attached to one side of frame 11, again at an inclined angle directed toward the water 40. The roller 14 is mounted to the lower end of arm 81 in a manner identical to the mounting described for arm 71 of FIGS. 7 and 8. A grip 77 is again provided for moving the arm 81 between the storage and dispensing positions.

Figure 12:
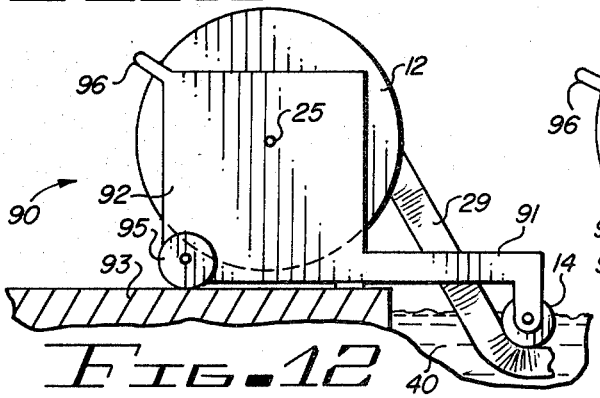
FIG. 12 is a first side view of the vacuum hose storage and dispensing apparatus of the invention in a fifth embodiment.
Figure 13:
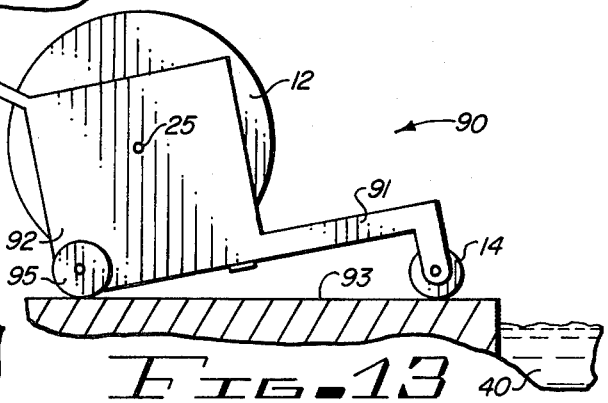
FIG. 13 is a second side view of the apparatus of FIG. 12.

The storage and dispensing apparatus 90 of FIGS. 12 and 13 represents a somewhat more radical departure from the construction of the apparatus 10. The apparatus 90 utilizes a fixed arm 91 which is rigidly attached to the frame 92. The frame 92 again carries the reel 12 rotatably mounted from a shaft 25. In the position of the apparatus 90 at the edge of the pool deck 93 as shown in FIG. 12, the arm 91 extends horizontally past the edge of the pool and then bends downward toward the water. At the lower termination of arm 91 the submerging roller 14 is rotatably mounted as in the case of the embodiments of the invention already described. The roller 14 again causes the hose 29 to be deflected beneath the surface of the water 40 as it is drawn off the reel 12 during the dispensing operation. When the hose 29 has been restored to its postion on reel 12 the apparatus 90 is simply withdrawn from the pool as shown in FIG. 13. The roller 14 then serves as a wheel in cooperation with additional wheels 95 mounted at the rear of frame 92, the wheels thus provide facilitating the moving of the apparatus 90 from one position to another. A handle 96 attached to the frame 92 may also be provided as an aid in moving the apparatus 90.

A practical and effective apparatus is thus provided for use in the storage and dispensing of a swimming pool vacuum hose. The apparatus as herein described meets the stated objects of the invention, and although but a few embodiments of the invention have been illustrated and described, it will be apparent to those skilled in the art that various changes and modifications may be made therein without departing from the spirit of the invention or from the scope of the appended claims.

What is claimed is:

1. A swimming pool vacuum hose storage and dispensing device comprising:

a frame, a reel rotatably mounted on said frame for storage and dispensing of a vacuum hose coiled thereround, a hose submerging means mounted on said frame, said submerging means being movable to a hose dispensing position where a part of said submerging means is positioned below said frame and in the water of a pool when said device is positioned poolside, and hose guiding means positioned on said part for guiding and submerging the hose in the water of the pool when dispensed from said reel, said submerging means comprising at least one arm member pivotally mounted at one end on said frame with its free end being rotatably movable to said hose dispensing position, and said guiding means comprising a roller mounted on said free end for guiding and submerging the hose when it is passed under said roller during a hose dispensing operation of the device.

2. The swimming pool vacuum hose storage and dispensing device set forth in claim 1 in further combination with a gripper mounted on said reel for holding one end of the hose as it is coiled aroung the reel.

3. The swimming pool vacuum hose storage and dispensing device set forth in claim 2 wherein:

said gripper comprises a conical shaped configuration receiving at its necked down end around its outer surface one end of the hose, the hollow interior of said configuration being open to atmosphere at its other end for providing a source of air to the interior of the hose as it is being warpped around said reel and for providing a path for the escape of air from the interior of the hose as it is dispensed into the water.

4. The swimming pool vacuum hose storage device set forth in claim 3 wherein:

said gripper is pivotally mounted on said reel.

5. The swimming pool vacuum hose storage and dispensing device set forth in claim 1 in further combination with:

handle means attached to said reel for rotating said reel to wind up and dispense the vacuum hose therefrom.

6. The swimming pool vacuum hose storage and dispensing device set forth in claim 1 in further combination with:

at least one pair of wheels journaled on said frame for moving the device to and from poolside.

7. The swimming pool vacuum hose storage and dispensing device of claim 6 wherein:

said wheels are mounted to said frame in a manner which causes said wheels to leave the surface on which said device is resting while not being moved about on said wheels, whereby the loss of contact between said wheels and said surface promotes the stability of said device during a hose dispensing operation of the device.

8. A swimming pool vacuum hose storage and dispensing device comprising:

a frame, a reel rotatably mounted on said frame for storage and dispensing of a vacuum hose coiled thereround, a hose submerging means mounted on said frame, said submerging means being movable to a hose dispensing position where a part of said submerging means is positioned below said frame and in the water of a pool when said device is positioned poolside, and hose guiding means positioned on said part for guiding and submeging the hose in the water of the pool when dispensed from said reel.

9. A swimming pool vacuum hose storage and dispensing device comprising:

a frame, a reel rotatably mounted on said frame for storage and dispensing of a vacuum hose coiled thereround, a hose submerging means mounted on said frame, said submerging means being movable to a hose dispensing position where a part of said submerging means is positioned below said frame and in the water of a pool when said device is positioned poolside, and hose guiding means positioned on said part for guiding and submerging the hose in the water of the pool when dispensed from said reel, said submerging means comprising at least one arm member pivotally mounted at one end on said frame with its free end being rotatably movable to said hose dispensing position, and said guiding means comprising a concave guiding plate mounted on said free end for guiding the hose when it is passed around said guiding means to submerge the hose and hold it submerged when the hose is being dispensed from the device.

10. The swimming pool vacuum hose storage and dispensing device set forth in claim 9 in further combination with:

a gripper mounted on said reel for holding one end of the hose as it is coiled around the reel.

11. The swimming pool vacuum hose storage and dispensing device set forth in claim 10 wherein:

said gripper comprises a conical shaped configuration receiving at its necked down end around its outer surface one end of the hose, the hollow interior of said configuration being open to atmosphere at its other end for providing a source of air to the interior of the hose as it is being wrapped around said reel and for providing a path for the escape of air from the interior of the hose as it is dispensed into the water.

12. The swimming pool vacuum hose storage and dispensing device set forth in claim 9 in further combination with:

handle means attached to said reel for rotating said reel to wind up and dispense the vacuum hose therefrom.

13. A swimming pool vacuum hose storage and dispensing device comprising:

a frame, a reel rotatably mounted on said frame for storage and dispensing of a vacuum hose coiled therearound, a hose submerging means mounted on said frame, said submerging means being movable to a hose dispensing position where a part of said submerging means is positioned below said frame and in the water of a pool when said device is positioned poolside, and hose guiding means positioned on said part for guiding and submerging the hose in the water of the pool when dispensed from said reel, said submerging means comprising at least one arm rigidly mounted at one end of said frame with its free end extending therefrom in a direction which permits it to reach said hose dispensing position when said device is positioned poolside, said guiding means comprising a roller mounted on said free end for guiding and submerging the hose when it is passed under said roller during a hose dispensing operation of the device, and said guiding means serving also as a wheel for facilitating the moving of said device from one place to another.

14. A swimming pool vacuum hose storage and dispensing device comprising:

a frame, a reel rotatably mounted on said frame for storage and dispensing of a vacuum hose coiled therearound, a hose submerging means mounted on said frame, said submerging means being movable to a hose dispensing position where a part of said submerging means is positioned below said frame and in the water of a pool when said device is positioned poolside, hose guiding means positioned on said part for guiding and submerging the hose in the water of the pool when dispensed from said reel, and a braking member mounted on said submerging means for inhibiting the rotation of said reel and the loosening of said hose on said reel while said device is being moved from one place to another, said braking member being moved to a braking position when said submerging means is moved to a storage position, and said braking means being moved to a free or non-braking position when said submerging means is moved to a dispensing position.

* * * * *